US005169303A

United States Patent [19]

Paluck

[11] Patent Number: 5,169,303

[45] Date of Patent: Dec. 8, 1992

[54] GAS RANGE IGNITION, REIGNITION DEVICE

[75] Inventor: Paul D. Paluck, Orland Park, Ill.

[73] Assignee: Capable Controls Co., Bensenville, Ill.

[21] Appl. No.: 723,407

[22] Filed: Jul. 1, 1991

[51] Int. Cl.[5] ..... F23Q 9/08

[52] U.S. Cl. ..... 431/74; 431/71

[58] Field of Search ..... 431/46, 47, 71, 74, 431/18, 27, 70, 78, 264; 361/256, 257

[56] References Cited

U.S. PATENT DOCUMENTS 3,520,645 7/1970 Cotton et al. ..... 431/78
4,231,732 11/1980 Newport, Jr. et al. ..... 431/74 X
4,533,973 8/1985 Kimmel ..... 431/264 X
4,535,380 8/1985 Geary ..... 431/264 X

*Primary Examiner*—Carl D. Price
*Attorney, Agent, or Firm*—Hill, Van Santen, Steadman & Simpson

[57] ABSTRACT

An ignition/reignition device for a gas burner which eliminates the isolation transformer of the prior art which includes a capacitive discharge curcuit which is connected to a high voltage transformer so as to provide ignition pulses to ignite a gas burner and which has a flame current amplifier and flame rectification sensors connected to the capacitive discharge circuit so as to control it so that spark discharges will occur if the burner has been turned on and such sparks will continue until ignition and wherein upon disappearance of the flame the sparks will again occur to reignite the burner.

7 Claims, 1 Drawing Sheet

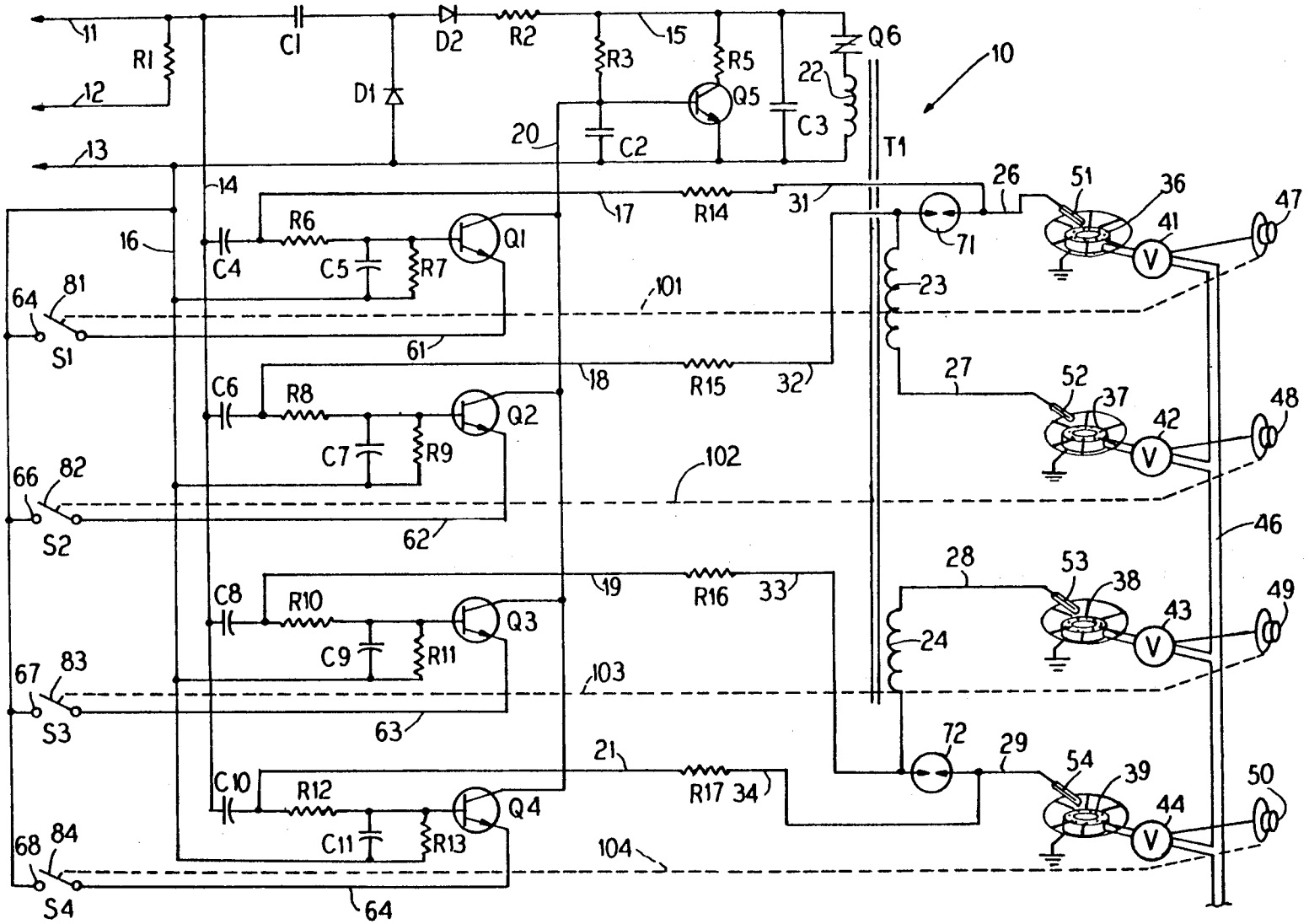
10
T1
Q6
Q5
Q1
Q2
Q3
Q4
S1
S2
S3
S4
R1
R2
R3
R5
R6
R7
R8
R9
R10
R11
R12
R13
R14
R15
R16
R17
C1
C2
C3
C4
C5
C6
C7
C8
C9
C10
C11
D1
D2
101
102
103
104

GAS RANGE IGNITION, REIGNITION DEVICE

BACKGROUND OF THE INVENTION

1. Field of the Invention

This invention relates in general to ignition and reignition devices for gas ranges and in particular to an improved device which eliminates an isolation transformer required in prior art devices.

2. Description of Related Art

Igniters of the prior art have required a line isolation transformer to provide alternating current operating current and the present invention eliminates the requirement for such transformer.

SUMMARY OF THE INVENTION

The present invention comprises an improved version of the current gas range ignition/reignition devices and provides initial burner ignition for gas ranges as well as reignition in the event of a flame failure. The device accomplishes this by generating high voltage sparks at each gas range burner and continuously monitoring each burner in use for the presence of flame. In the event that flame is lost at any of the electronically monitored burners, high voltage sparks will again be generated to reignite the burner. The reignition device of the invention can be used in four burner "sealed burner" gas ranges, but may also be applied to various surface burner types and other gas burning devices with any number of burners.

So as to provide gas ignition/reignition, the device employs a high voltage pulse transformer with a capacitive discharge means of excitement. The invention also utilizes an alternating current "flame rectification" method of flame sensing. This operates such that when a flame is present, the flame acts like a diode and cuts off positive half cycles of an applied alternating current signal. A flame sensing portion of the invention controls the capacitive discharge/pulse transformer section which causes the generation of high voltage sparks as required.

Prior art devices have required the use of a 1:1 line isolation transformer to provide alternating current operating current and the need for this transformer in the prior art is to eliminate spurious high voltage sparking. These sparks are generated as a result of an intermittent application of an ohmic connection between the ignition sensing electrode and a grounded surface (with the AC power lines, line and neutral connections reversed). The ground connection might be the gas range burner or other metallic or conductive surfaces. In the prior art devices, the errant sparking condition which results from operating these reignition devices without a 1:1 isolation transformer presents a hazardous condition. Sparking may, for instance, occur during a normal damp rag cleaning of the burner. The present invention eliminates this 1:1 isolation transformer of the prior art.

It is an object of the present invention to provide an improved ignition, reignition device for a gas burner.

It is another object of the invention to provide an improved gas ignition, reignition device which eliminates an isolation transformer required in prior art devices.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

The FIG. is an electrical schematic view of the ignition/reignition device of the invention.

DETAILED DESCRIPTION OF THE PREFERRED EMBODIMENTS

The FIG. illustrates the flame igniter/reigniter circuit 10 and comprises incoming power leads 11, 12 and 13 which are connected to a suitable 120 volt power source for example, and includes a neutral line 11, a common line 12 which is grounded and separated from the neutral 11 by a resistor R1 and a power line 13. A capacitor C1 is connected between neutral line 11 and diode D2 which has its other side connected to a resistor R2 which has its other side connected to a line 15. A diode D1 is connected between line 13 and the junction point between the capacitor C1 of the diode D2. A resistor R5 is connected to line 15 and has its other side connected to the collector of a transistor Q5 which has its emitter connected to line 13. A resistor R3 is connected from line 15 to a line 20 and to a capacitor C2 which has its other side connected to the line 13.

A capacitor C3 comprises the pulse capacitor and is connected between lines 15 and 13. A Sidac Q6 is connected from line 15 to the primary 22 of a transformer T1 and has its other side connected to line 13.

A transistor Q1 has its collector connected to line 20 and its emitter connected by lead 61 to the moveable contact 81 of a switch S1. The stationary contact 64 of switch S1 is connected to lead 16 which is connected to line 13. A capacitor C4 is connected from line 14 to a resistor R6 which has its other side connected to the base of transistor Q1. Capacitors C5 and resistor R7 are connected in parallel between the base of transistor Q1 and line 16. Line 14 is connected to line 11.

A transistor Q2 has its collector connected to line 20 and its emitter connected to line 62 which is connected to a moveable contact of switch S2 which has its fixed contact 66 connected to line 16. A capacitor C6 is connected from line 14 to resistor R8 which has its other side connected to the base of transistor Q2. Capacitor C7 and a resistor R9 are connected in parallel between the base of transistor Q2 and lead 16.

A transistor Q3 has its collector connected to lead 20 and its emitter connected to lead 63 which is connected to a moveable contact 83 of a switch S3 which has its fixed contact 67 connected to line 16. A capacitor C8 is connected between line 14 and a resistor R10 which has its other side connected to the base of transistor Q3. Capacitor C9 and resistor R11 are connected in parallel between the base of transistor Q3 and line 16.

A transistor Q4 has its collector connected to line 20 and its emitter connected to line 64 which is connected to a moveable contact 84 of a switch S4 which has its fixed contact 68 which is connected to line 16. A capacitor C10 is connected between line 14 and the resistor R12 which has its other side connected to the base of transistor Q4. Capacitor C11 and resistor R13 are connected in parallel between the base of transistor Q4 and line 16.

The junction point between the capacitor C4 and the resistor R6 is connected to a lead 17 which is connected to resistor R14. A lead 31 is connected to the other side of resistor R14 and to a lead 26 which is connected to a flame igniter 51 mounted adjacent a burner 36. The junction point between capacitor C6 and resistor R8 is connected to lead 18 which is connected to one side of resistor R15 which has its other side connected to a lead 32 connected to a lamp 71 which has its other side connected to lead 26. A secondary 23 of transformer T1 is connected to lead 32 and to a lead 27 which is connected to flame igniter 52 of a second burner 37.

A lead 19 is connected between the junction point of capacitors C8 and resistor R10 and to a resistor R16 which has its other side connected to a lead 33 which is connected to a second secondary 24 of transformer T1 which has its other side connected to a lead 28 which is connected to flame igniter 53 for a third burner 38.

A lead 21 is connected to the junction point between capacitor C10 and resistor R12 and to a resistor R17 which has its other side connected to a lead 34 which is connected to the lead 29 which is connected to the flame igniter 54 mounted adjacent a fourth burner 39. A second gap device 72 which might be a neon discharge lamp is connected to lead 29 and has its other side connected to lead 33 as shown.

Gas is supplied to the burners 36, 37, 38, 39 from a gas manifold 46 which is respectively connected to the burners 36, 37, 38 and 39 through valves 41, 42, 43 and 44. Control knobs 47, 48, 49 and 50 are respectively connected to the valves 41, 42, 43 and 44 and to the switches S1, S2, S3 and S4 by linkages 101, 102, 103 and 104 so as to simultaneously operate the respective valve and switches.

The present invention may be earth grounded or not earth grounded and may be connected to the AC power line with either correct or reverse line polarity. In no case, however, will spurious sparking occur as in prior art devices. The invention eliminates spurious sparking by the unique method of the invention of activating and deactivating the flame current amplifier section. This method places the control switching element in the flame current amplifier(s) emitter circuit. This topology provides a complete break in the flame current transistor amplifier(s) emitter circuit. This activating and deactivating action is described below.

The invention comprises four inter-related sections which are the flame current amplifiers, the flame rectification sensors, the pulse inhibit circuit and the capacitive discharge circuit and the high voltage transformer.

In operation, when AC power is connected to the circuit on lines 11, 12 and 13 and with all of the ignition switches S1 through S4 in the off position, the transistor Q5 will be turned on. When transistor Q5 is turned on, it prevents the pulse capacitor C3 from being charged to a voltage high enough to cause the Sidac Q6 to conduct. When the Sidac Q6 does not conduct, no current flow will exist in the transformer primary 22. Thus, no high voltage is produced in the secondary windings 23 and 24 of the high voltage transformer T1 so that sparking will not occur under these conditions.

When one of the controls to one of the burners is turned on as, for example, control 47, this opens valve 41 to burner 36 and simultaneously closes switch S1 which activates the circuit associated with transistor Q1 and burner 36. This allows emitter current to flow through transistor Q1 to the AC power line.

When transistor Q1 turns on, it will drop the voltage through line 20 on the base of transistor Q5 so as to turn Q5 off so it becomes nonconducting. When this occurs, the capacitor C3 can charge to a sufficiently high voltage so as to cause conduction of Sidac Q6 which energizes the primary 22 of transformer T1 so as to generate high voltage pulses in the secondary windings 23 and 24 of transformer T1. The high voltage generated, for example, by a secondary 23 will pass through gap device 71 to lead 26 to the igniter 51 of burner 36 so as to ignite gas flowing from the burner. When the flame of the burner 36 has been established by the igniter, the gas flame acts as a diode between the igniter and the burner which is connected to the common of the power supply and the flame acting as a diode cuts off the positive half cycles of the applied AC signal which is sensed by the transistor Q1 through the lead 17 which is connected through resistor R6 to its base, thus turning off transistor Q1. When transistor Q1 is turned off, the transistor Q5 turns on thus preventing the capacitor C3 from being charged to a voltage sufficiently high to cause high voltage ignition pulses. In the event the flame at burner 36 goes out, the transistor Q1 will again conduct and again turn off transistor Q5 which will allow the capacitor C3 to charge to a voltage sufficiently high to cause the Sidac Q6 to conduct producing high voltage pulses in the secondary 23 of transformer T1 so as to again reignite the burner 36. As soon as reignition occurs, the transistor Q1 will again turn off thus turning on transistor Q5.

It is to be realized, of course, that any of the burners 36, 37, 38 and 39 can be operated one at a time or all at the same time or any two or three at the same time as is conventional in operation of gas ranges having four burners, for example. Thus, for example, if switch S2 is closed by moving the control 48, the gas valve 42 will be opened and the transistor Q2 will start to conduct turning off transistor Q5 thus energizing the high voltage pulse circuit so that the igniter 52 will be energized from the secondary 23 to ignite the burner 37. As soon as ignition occurs, the voltage will drop on the base of transistor Q2 to turn it off which will in turn turn on transistor Q5. The same operation occurs when the switches S3 and S4 are closed when it is desired to ignite burners 38 and 39.

As the range operates with one or more of the burners ignited, if such ignited burners loose their flame, the circuit will cause those burners to be reignited as described above.

The described ignition/reignition process will continue as long as any one of the switches S1 through S4 is in the closed position.

The principal advantages of the invention is that the invention operates with no errant sparking and eliminates the need of an external 1:1 line isolation transformer used in the prior art. The elimination of this isolation transformer required by the prior art devices lowers the overall cost of the product and makes it simpler. The invention operates in a safer manner than the prior art devices in that there are no sparks which occur during damp rag cleaning at the burner electrode area and, thus, a hazard of the prior art devices has been eliminated with the invention.

Alternate arrangements can also be made with the circuit wherein external ignition switching is formed as a series circuit arrangement with the flame current amplifiers in the collector circuit. Also, the addition of semiconductor control elements acting as series or shunt switch in the flame sensing transistor emitters or the collector circuits can be used. Such additional semiconductors can be controlled by an external ignition control switch.

The present invention can be used in gas range surface burner igniters, gas range oven igniters, gas furnace or area heater igniters, gas water heater igniters and clothes dryer igniters.

Although the invention has been described with respect to preferred embodiments, it is not to be so limited as changes and modifications can be made which are within the full intended scope of the invention as defined by the appended claims.

I claim as my invention:

1. A circuit for igniting and reigniting a plurality of gas burners comprising, an A.C. power supply, a plurality of igniters with one mounted adjacent each of said gas burners, a high voltage transformer with its secondary connected to said igniters, a pulse generating circuit connected to said power supply and to the primary of said transformer, a pulse inhibit circuit connected to said power supply and to said pulse generating circuit, a plurality of flame sensing circuits each connected to one of said igniters and to said pulse inhibit circuit and to said power supply, a plurality of switches each connected to one of said plurality of flame-sensing circuits such that if a switch is actuated said burner will be lit by said pulse generating circuit and after said burner has been lighted said pulse generating circuit will be inhibited, wherein said pulse generating circuit comprises a charging capacitor and a discharge transistor connected to the primary of said high voltage transformer, wherein said discharge transistor is a Sidac, and wherein each of said flame-sensing circuits each comprise an igniter mounted adjacent a burner to ignite it and a third transistor connected to said igniter and to one of said switches and to said second transistor of said pulse inhibit circuit.

2. A circuit according to claim 1 wherein said igniter is connected to the base of said third transistor.

3. A circuit according to claim 2 wherein the collector of said third transistor is connected to the base of said second transistor.

4. A circuit according to claim 2 wherein said switch is connected between the emitter of said third transmission and one side of said power supply.

5. A circuit according to claim 3 wherein a secondary of said transformer is connected to at least one of said igniters.

6. A circuit according to claim 5 including a neon device mounted between said secondary and one of said igniters.

7. A circuit according to claim 1 wherein said pulse inhibit circuit comprises a second transistor connected to said power supply and to said changing capacitor.

* * * * *